US010370850B2

(12) United States Patent
Candiracci

(10) Patent No.: US 10,370,850 B2
(45) Date of Patent: Aug. 6, 2019

(54) ANTIPERFORATION BUILDING PANEL STRUCTURE

(71) Applicant: Angelo Candiracci, Fano (IT)

(72) Inventor: Angelo Candiracci, Fano (IT)

( * ) Notice: Subject to any disclaimer, the term of this patent is extended or adjusted under 35 U.S.C. 154(b) by 0 days.

(21) Appl. No.: 15/768,828

(22) PCT Filed: Oct. 21, 2016

(86) PCT No.: PCT/EP2016/075386
§ 371 (c)(1),
(2) Date: Apr. 16, 2018

(87) PCT Pub. No.: WO2017/068128
PCT Pub. Date: Apr. 27, 2017

(65) Prior Publication Data

US 2018/0305928 A1 Oct. 25, 2018

(30) Foreign Application Priority Data

Oct. 22, 2015 (IT) ..... 102015000064555

(51) Int. Cl.
*E04C 2/292* (2006.01)
*E04B 2/84* (2006.01)
*E04C 2/20* (2006.01)

(52) U.S. Cl.
CPC ..... *E04C 2/292* (2013.01); *E04B 2/847* (2013.01); *E04C 2/205* (2013.01)

(58) Field of Classification Search
CPC ..... E04C 2/292; E04C 2/205; E04B 2/847
USPC ..... 52/340, 309.8, 341, 319, 303, 505, 307, 52/602, 309.17, 405.3, 415, 405.1; 428/117, 112, 304.4, 411.1, 132, 593; 264/45.4, 126
See application file for complete search history.

(56) References Cited

U.S. PATENT DOCUMENTS 1,154,254 A * 9/1915 Lachman ..... B29C 47/0066 29/897.32
2,534,580 A * 12/1950 Edwards ..... E04C 2/06 52/136
3,495,367 A * 2/1970 Kobayashi ..... E04B 1/04 52/223.6
3,814,778 A * 6/1974 Hashimoto et al. .... B29C 41/04 108/57.28

(Continued)

FOREIGN PATENT DOCUMENTS

GB 842937 7/1960
GB 1249458 10/1971

(Continued)

*Primary Examiner* — Joshua K Ihezie
(74) *Attorney, Agent, or Firm* — Themis Law

(57) ABSTRACT

An antiperforation building panel structure, particularly made of sintered expanded polystyrene (eps), includes a composite complex structure having embedded, in the sintered expanded polymeric mass, preferably of the high density type, a steel box-shaped structure with larger faces divided into first fields having larger openings therein and second fields having smaller fissures therein, the first and the second fields being arranged in positions that are inversely symmetric on the two faces, so that each first field on one face corresponds to a second field on the other face and vice versa.

10 Claims, 4 Drawing Sheets

(56) References Cited

U.S. PATENT DOCUMENTS 3,869,778 A * 3/1975 Yancey ..... B21D 47/00 428/573
4,076,880 A * 2/1978 Geschwender ..... B28B 5/027 428/116
4,141,946 A * 2/1979 Rauenhorst ..... B28B 7/186 264/228
4,409,274 A * 10/1983 Chaplin ..... B32B 3/28 428/112
4,522,860 A * 6/1985 Scott ..... B21D 31/04 428/132
4,593,449 A * 6/1986 Meray-Hovarth ..... B29C 44/1276 29/527.1
4,637,184 A * 1/1987 Radtke ..... E04F 15/123 249/65
5,806,264 A * 9/1998 Boot ..... E04C 2/382 52/405.1
5,930,970 A * 8/1999 De Le fevre ..... E04G 9/02 52/630
6,412,243 B1 * 7/2002 Sutelan ..... B29C 44/12 428/182
6,536,168 B1 * 3/2003 Cugini ..... E04B 1/04 52/220.2
6,581,352 B1 * 6/2003 Amirsoleymani ..... E04C 2/382 52/309.17
7,188,455 B2 * 3/2007 Brugeaud ..... E04B 7/22 52/309.12
7,288,326 B2 * 10/2007 Elzey ..... C22F 1/006 428/179
D647,685 S * 10/2011 Atkins ..... B65D 19/0012 D34/38
8,114,524 B2 * 2/2012 Durney ..... E04B 2/78 428/132
8,438,981 B2 * 5/2013 Linares ..... B65D 19/0012 108/57.22
8,943,771 B2 * 2/2015 Garcia ..... E04B 5/48 52/319
9,175,469 B2 * 11/2015 Toopchinezhad ..... B28B 7/183
2005/0034401 A1 2/2005 Sutelan
2005/0055922 A1 * 3/2005 Shamsai ..... E04C 3/34 52/319
2005/0188649 A1 * 9/2005 Hagen, Jr. ..... B29C 44/186 52/782.1
2006/0265985 A1 * 11/2006 Nichols ..... E04C 2/384 52/309.8
2009/0120025 A1 * 5/2009 Sezen ..... E04C 3/20 52/340
2010/0101171 A1 * 4/2010 Clifton ..... E04C 2/28 52/588.1
2012/0276364 A1 * 11/2012 Kennedy ..... B32B 3/08 428/304.4
2013/0160385 A1 * 6/2013 Alarcon Garcia ..... E04B 5/328 52/340

FOREIGN PATENT DOCUMENTS

WO 9428262 12/1994
WO 2004063493 7/2004

* cited by examiner

ANTIPERFORATION BUILDING PANEL STRUCTURE

STATE OF THE ART

In the building industry, on the one hand there is known reinforced concrete, A material obtained from the aggregation of concrete and steel to complement a synergic coadjutant action:

as a matter of fact concrete is suitable for bearing compression stresses but it tends to crack even under pressure from very low tensile stress.

When a concrete product is subjected to bending, tensile and compression stresses arise. The fissures that are formed in the strained area tend to rapidly propagate and the product collapses immediately.

In order to subject the concrete products to bending, steel—i.e. a material capable of resisting to tensile stress—is arranged in the strained area. The tensile stresses are transferred from the concrete to the steel which traverses the fissure limiting the development thereof.

Shear stresses also cause stress and thus the concrete has to be provided with reinforcement capable of absorbing the tensile stresses generated by the shear.

Thus, the reinforcement of an inflexed product is constituted by "longitudinal" iron pieces which absorb the tensile stresses related to the bending and "brackets" or "bent pieces of iron" which absorb the tensile stresses generated by the shear.

In the building industry, on the other hand, there are known building panels of the "sandwich" type made of a steel wire mesh and sintered expanded plastic material formed by a sheet-like core made of sintered expanded plastic material, for example and preferably polystyrene with differentiated density as a function of the intended building use of the panel, caged between two electrowelded wire meshes, mutually joined, also electrowelded, by two steel wires segments to obtain two crosspieces perforating said core.

The single-block product thus made may be may be modularly arranged and plastered, held by the metal meshes to form prefabricated walls with optimal resistance, antiseismic, heat insulation, sound-proof and fire-proof characteristics.

Furthermore, a twinned pair of panels thus made may be used—with excellent results—as a disposable formwork i.e. a container where concrete is cast between the two panels which remain incorporated therewith, englobed to collaborate with the formation of the wall, contingently plastered on the outer walls thereof just like a single panel.

Further methods of utilisation of the building panels of the sandwich type with a steel mesh and sintered expanded material provides for inserting panels into the conventional formworks for holding the concrete cast and removed upon drying, for reinforcing, lightening, insulating and soundproofing the walls they are applied to.

With the aim of combining—for building purposes—the characteristics of reinforced concrete and those of sintered expanded polystyrene panels associated to metal meshes, to obtain an innovative product with a wide range of applications in the building industry, the applicant of this document conceived a prefabricated building structure made of sintered expanded polystyrene (eps), in particular a panel, subject of the industrial invention patent application no. 102014902243932 (PS2014A000004) filed on 18 Mar. 2014, comprising a composite complex structure by aggregating steel to the sintered expanded polymeric mass, preferably of the high density type, by embedding steel rod-like elements thereinto, preferably pre-assembled to form electrowelded cage elements; as well as with the relative production method according to the present invention comprising arranging steel rod-like elements, preferably pre-assembled to form a cage of electrowelded elements, in the polystyrene expansion mould, pouring—into the mould—incoherent granules or beads obtained from the polymerisation of styrene with grain size and volume suitable for obtaining a finished product of a high density, expansion and sintering i.e. incorporating incoherent polystyrene through contact with water vapour at a temperature higher than ninety centigrade and the ensuing trapping of the reinforcement into the monolithic mass thus obtained to achieve a solid shape, depending on the mould, of reinforced sintered expanded polystyrene.

OBJECTS OF THE INVENTION

In this context, the main object of the present invention is to provide aa prefabricated building product structure made of sintered expanded polystyrene (eps), in particular a panel, dependent on the object of the industrial invention patent application no 102014902243932 (PS2014A000004) filed on 18 Mar. 2014, comprising a complex forming a composite by aggregating steel to the sintered expanded polystyrene, preferably of the high density type, by embedding—thereinto—steel elements conferring the panel antiperforation and anti-breaking characteristics.

Another object of the present invention is to attain the aforementioned object through a panel that, though substantially armoured, remains the lightest possible.

Still another object of the present invention is to attain the aforementioned objects and also provide for a preferred embodiment of the product capable of optimising the quick and easy laying on site distinctive characteristics thereof, as well as versatility and modularity.

A further object of the present invention is to attain the aforementioned objects through a product that is simple and functional, safe to use and relatively inexpensive considering the actual results attained therewith.

SUMMARY OF THE SOLUTION CONCEPT

These and other objects are attained by an antiperforation building panel structure, particularly made of sintered expanded polystyrene (eps), comprising a composite complex structure (1) by embedding—in the sintered expanded polymeric mass (2), preferably of the high density type—a steel box-shaped structure (3) with larger faces (4, 5) divided into empty fields (6) and full fields (7) inversely symmetric in the two faces (4, 5), so that each empty field (6) on one face (4) corresponds to a full field (7) on the other face (5) and vice versa.

DESCRIPTION OF THE ATTACHED DRAWINGS

Further characteristics and advantages of the antiperforation building panel structure according to the present invention shall be more apparent from the following detailed description of a preferred but non-exclusive embodiment thereof, represented solely by way of non-limiting example with reference to the four attached drawings, wherein.

STATIC DESCRIPTION OF THE PREFERRED EMBODIMENT

Figure 1:
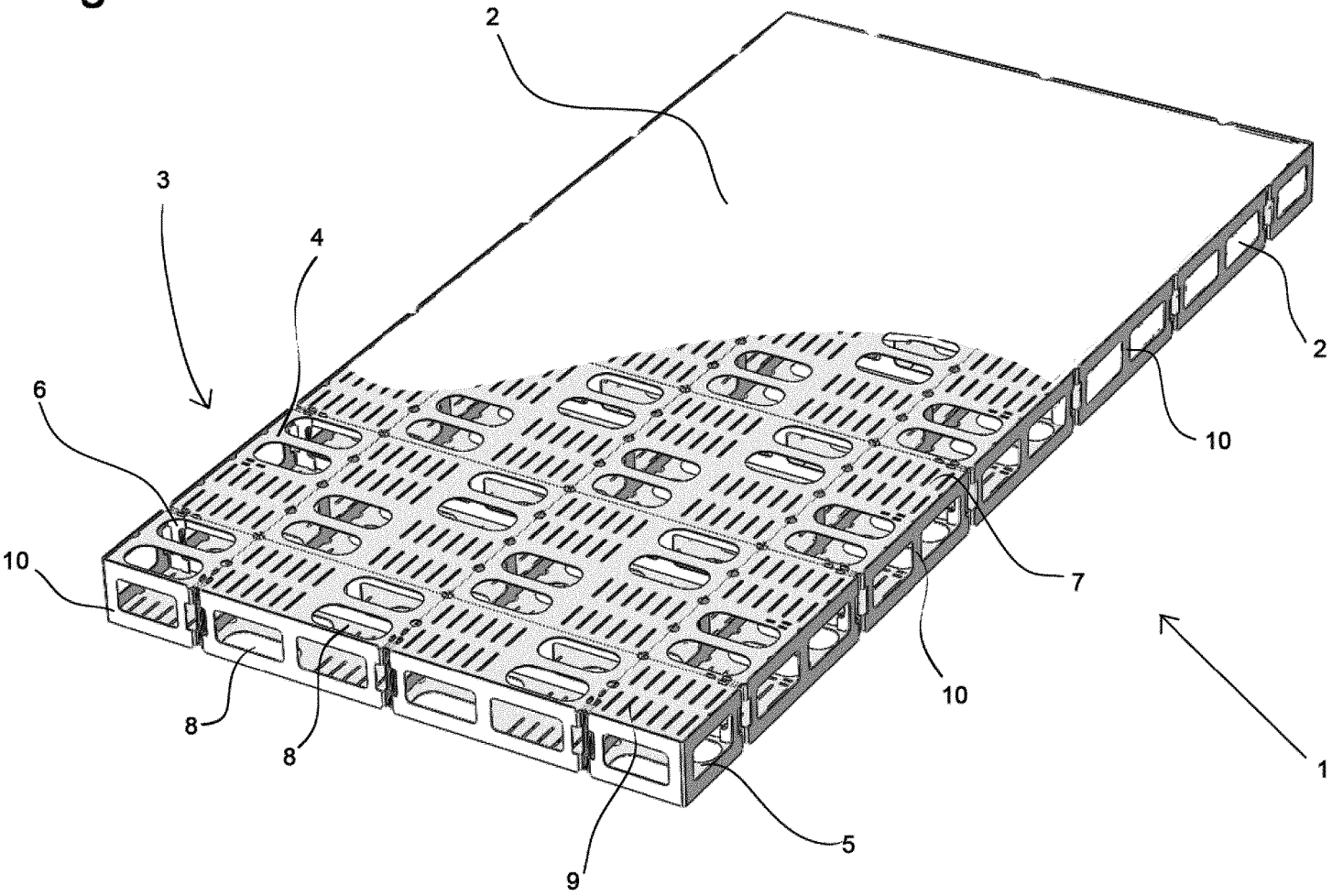
FIG. 1 illustrates a perspective view of an antiperforation building panel according to the present invention, partly sectioned.
Figure 2:
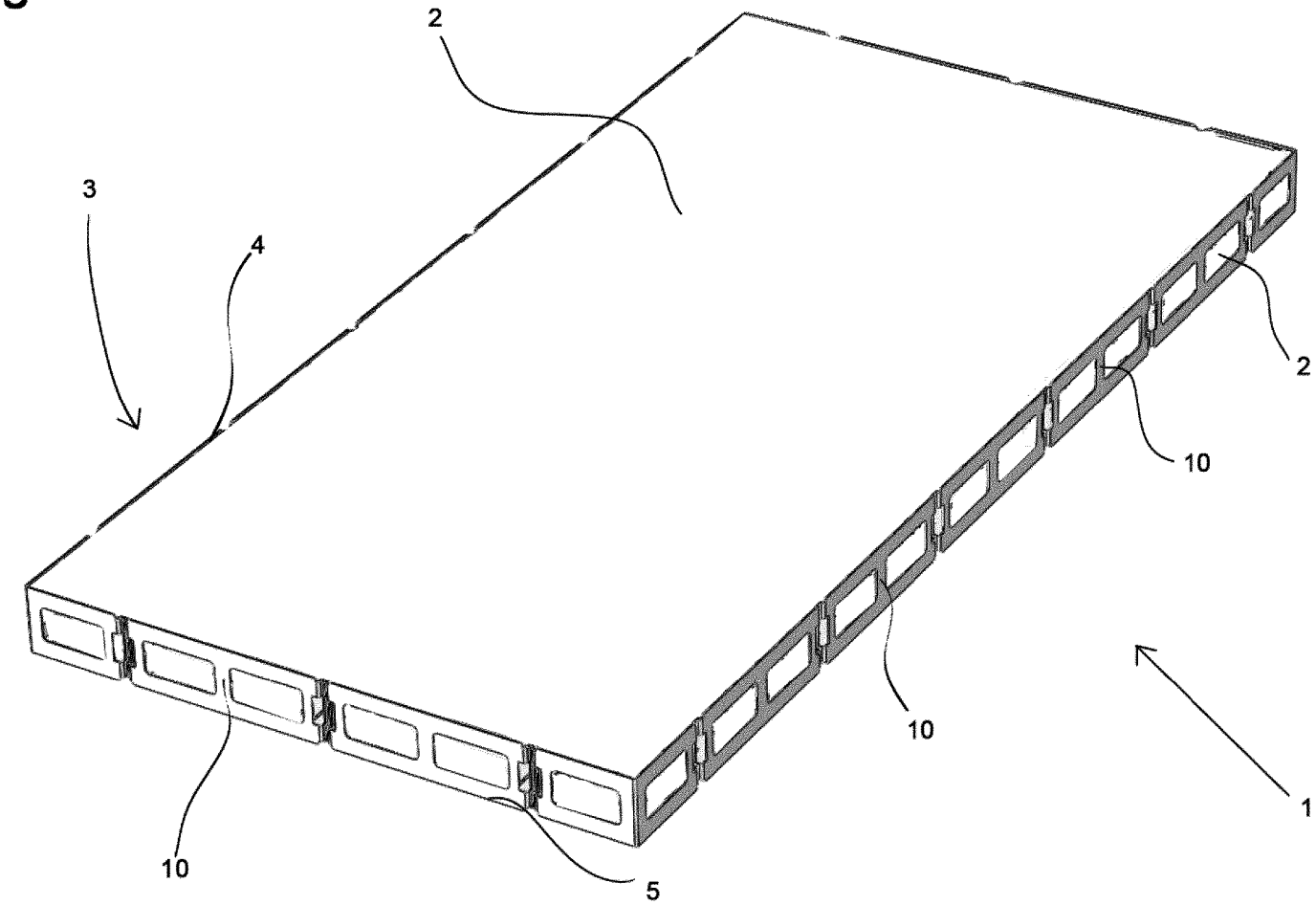
FIG. 2 illustrates a perspective view of an antiperforation building panel according to the present invention.

With reference to such figures and in particular FIG. 1, an embodiment of a composite building panel made of sintered expanded polystyrene 2 according to the present invention, preferably of the high-density type, preferably from 30 (thirty) to 50 (fifty) kg/m$^3$, is indicated in its entirety with 1.

In the mass of the composite building panel 1 made of sintered expanded polystyrene 2 there is embedded at least one steel box-shaped structure, indicated in its entirety with 3, for example formed by two counter-faced sheets 4 and 5, respectively configured with empty fields 6 and filled fields 7, square-shaped in the illustrated embodiment, equally dimensioned and alternatingly arranged in a chequered fashion.

In the illustrated embodiment, the empty fields 6 are divided into two holes 8, while the full fields 7 have two symmetric parallel fissures 9.

The empty fields 6 and the full fields 7 are inversely symmetrical in the two counter-faced sheets 4 and 5, so that for each full field on one face there corresponds an empty one on the other and vice versa.

The two counter-faced sheets 4 and 5 are joined to form at least one box-shaped structure 3 with a plurality of segments or crosspieces 10.

Figure 3:
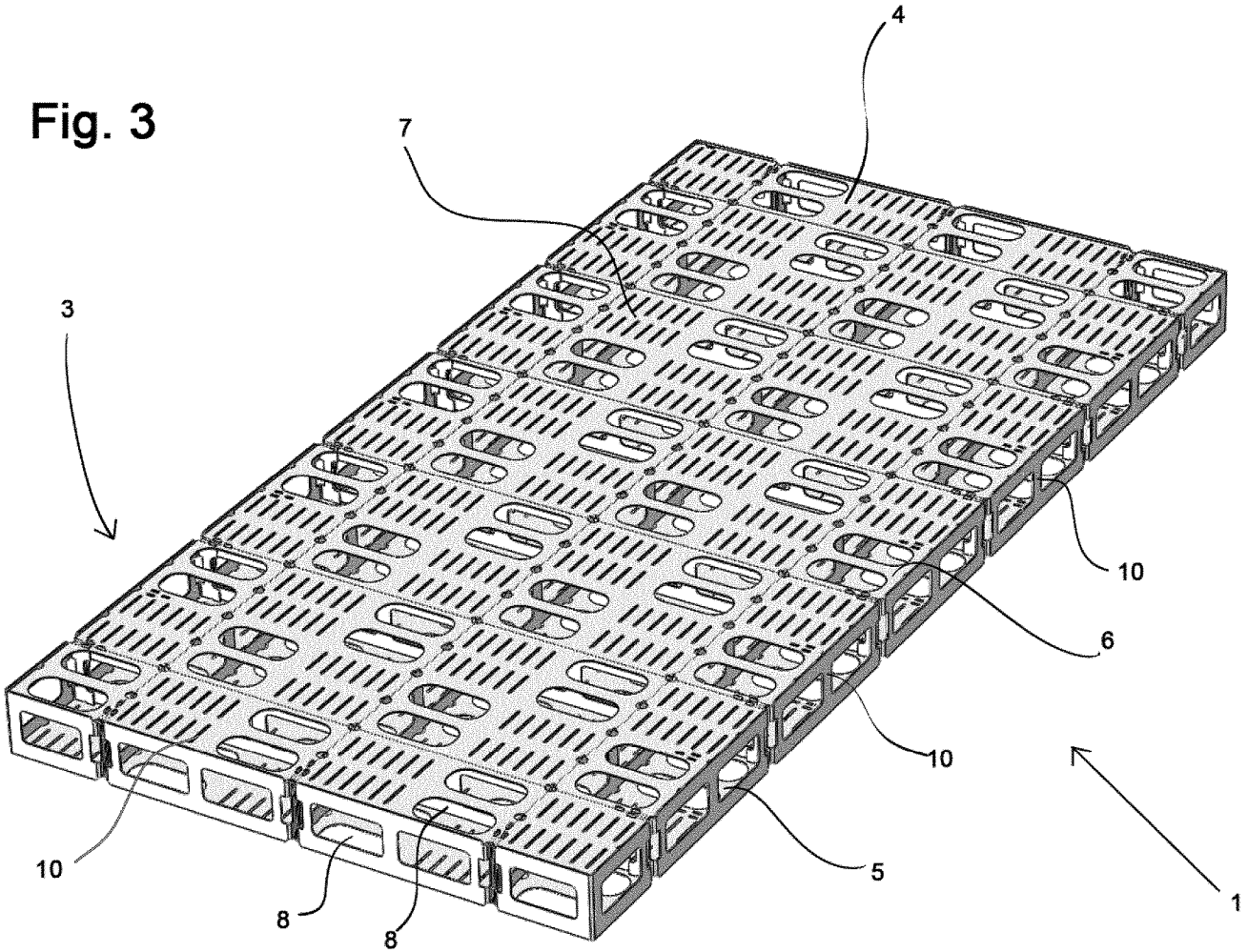
FIG. 3 illustrates a perspective view of the reinforcement of an antiperforation building panel according to the present invention.
Figure 4:
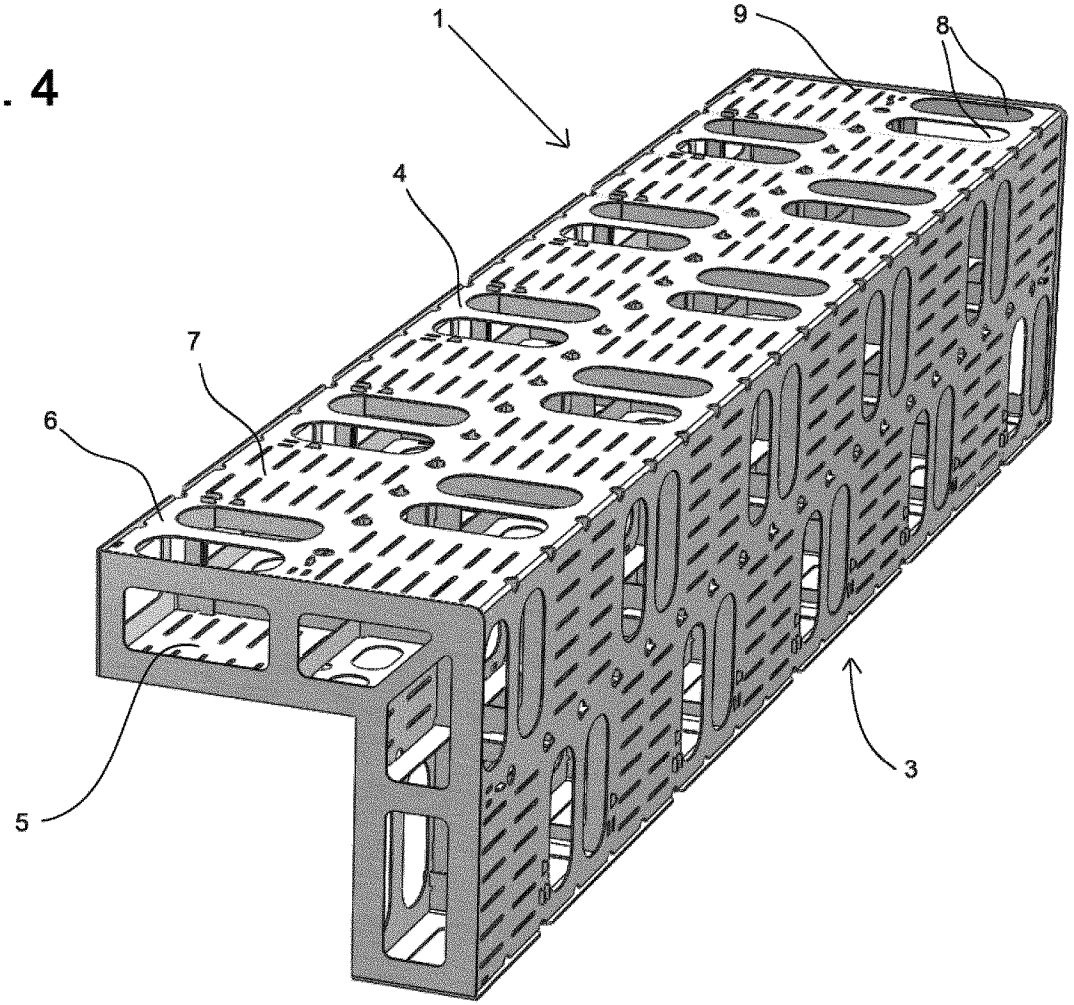
FIG. 4 illustrates a perspective view of an alternative embodiment of the reinforcement of an antiperforation building panel according to the present invention.

FIG. 3 illustrates an alternative of the box-shaped structure 3 according to the present invention, where the parallel counter-faced sheets 4 and 5 are bent by 90° to form a corner.

DYNAMIC DESCRIPTION OF THE PREFERRED EMBODIMENT

Thus, having completed the static description of a preferred embodiment of the prefabricated building product structure made of sintered expanded polystyrene according to the present invention, following is the dynamic description of the same, i.e. the relative operation:

the products or panels 1 have characteristics similar to analogous reinforced concrete structures, in that sintered expanded polystyrene 2, in the density comprised between 30 (thirty) and 50 (fifty) kg/m$^3$, is suitable to bear compression stresses comparable to those of concrete, while in terms of stress such synthesis material reveals greater resistance to cracking, hence has greater elasticity, with respect to concrete.

In the products according to the present invention, same case applying to reinforced concrete, the stress forces are countered by the complementary coadjutant synergic action of the steel box-shaped structure 3, thus obtaining products comparable—in terms of structural and mechanical characteristics—to similar reinforced concrete products, but considerably lighter.

These products, obtained in any shape and dimension depending on the contingent implementation and design needs, may be mutually connected through any means suitable for the purpose to obtain substantially any building structure.

In this context, the distinctive structuring of the reinforcement 3 of the panels 1 according to the invention, formed by two counter-faced sheets 4 and 5, tied by crosspieces 10, respectively configured with full fields 6 and empty fields 7, equally dimensioned and arranged alternatingly in a chequered fashion in the two sheets, combines the characteristics of lightness typical of structures with antiperforation and anti-breaking characteristics, in that whereas a sheet is open for lightening purposes, the other is closed and vice versa so that a perforating body is blocked in any point of the relative extension.

ALTERNATIVE EMBODIMENTS

It is obvious that in alternative embodiments, still falling within the concept solution of the implementation example illustrated above and claimed below, the antiperforation building panel structure according to the present invention, may also be implemented and obtained differently, through equivalent technical and mechanical solutions still falling within the scope of protection illustrated and claimed below; In particular:

the dimensions and shapes of the empty and full fields interposed in the two parallel sheets may be variously obtained to suit the purpose;

in the illustrated embodiments, the empty fields have a pair of holes and the full ones have fissures, which respectively limit the concept of empty and full thereof; in addition, the emptiness may be solid, without divisions of any kind, just like the fullness can be solid, without any fissures;

the box-shaped structure may be monolithic or made up of a plurality of coplanar structures, mutually fixed and co-embedded in the expanded polymeric mass.

ADVANTAGES OF THE INVENTION

As observable from the previously outlined description of a preferred but non-exclusive embodiment, the antiperforation building panel structure according to the present invention, offers the advantages corresponding to the preset as well as other objects:

as a matter of fact, it integrates a simple, functional, modular and versatile solution concept to obtain a product suitable to constitute an alternative embodiment with respect to the elements made of reinforced concrete, and a building panel with unprecedented characteristics of robustness combined with lightness, with considerable advantages in terms of reducing weight and simultaneously comparable with other structural and mechanical characteristics as well as resistance to perforation and breaking.

KEY TO REFERENCE NUMBERS

1) panel in its entirety
2) sintered expanded polystyrene
3) box-shaped structure
4) first counter-faced sheet
5) second counter-faced sheet
6) empty fields
7) full fields
8) pair of holes of the empty fields
9) parallel fissures of the full fields
10) segments or crosspieces for mutual connection of the counter-faced sheets

The invention claimed is:

1. An antiperforation building panel structure comprising:

a composite complex structure having embedded, in a sintered expanded polymeric mass, a steel box-shaped structure with larger faces divided into first fields having larger openings therein, and second fields having smaller fissures therein, the first and the second fields being arranged in positions that are inversely symmetric in the larger faces, so that each first field on a face corresponds to a second field on the other face and vice versa, wherein said first fields and said second fields are defined by boxes that are equally dimensioned and arranged alternatingly in a chequered fashion.

2. The antiperforation building panel structure according to claim 1, wherein the sintered expanded polymeric mass has a density of 30-50 kg/m$^3$, and wherein the box-shaped structure has the larger faces disposed opposite to one another and joined by a plurality of segments or cross-pieces.

3. The antiperforation building panel structure according to claim 1, wherein said box-shaped structure is made up of a plurality of coplanar structures mutually fixed and co-embedded in the expanded polymeric mass so as to be configured to form a single panel structure.

4. The antiperforation building panel structure according to claim 1, wherein said box-shaped structure is made up of two counter-faced parallel sheets bent by 90° to form an angular element.

5. The antiperforation building panel structure according to claim 1, wherein the sintered expanded polymeric mass is made of sintered expanded polystyrene (eps).

6. An antiperforation building panel structure comprising:

a composite complex structure having embedded, in a sintered expanded polymeric mass, a steel box-shaped structure with larger faces divided into first fields having larger openings therein, and second fields having smaller fissures therein, the first and the second fields being arranged in positions that are inversely symmetric in the larger faces, so that each first field on a face corresponds to a second field on the other face and vice versa, wherein the larger openings in the first fields are two holes, and wherein the smaller fissures in the second fields are two symmetric two columns of parallel slots.

7. The antiperforation building panel structure according to claim 6, wherein the sintered expanded polymeric mass has a density of 30-50 kg/m$^3$, and wherein the box-shaped structure has the larger faces disposed opposite to one another and joined by a plurality of segments or cross-pieces.

8. The antiperforation building panel structure according to claim 6, wherein said box-shaped structure is made up of a plurality of coplanar structures mutually fixed and co-embedded in the expanded polymeric mass so as to be configured to form a single panel structure.

9. The antiperforation building panel structure according to claim 6, wherein said box-shaped structure is made up of two counter-faced parallel sheets bent by 90° to form an angular element.

10. The antiperforation building panel structure according to claim 6, wherein the sintered expanded polymeric mass is made of sintered expanded polystyrene (eps).

* * * * *